US006715374B2

(12) United States Patent
Kurasawa

(10) Patent No.: US 6,715,374 B2
(45) Date of Patent: Apr. 6, 2004

(54) STARTER MOTOR HAVING LEAF SPRING FOR DRIVING PINION GEAR

(75) Inventor: Tadahiro Kurasawa, Chita-gun (JP)

(73) Assignee: Denso Corporation, Kariya (JP)

( * ) Notice: Subject to any disclaimer, the term of this patent is extended or adjusted under 35 U.S.C. 154(b) by 43 days.

(21) Appl. No.: 09/985,133

(22) Filed: Nov. 1, 2001

(65) Prior Publication Data

US 2002/0096001 A1 Jul. 25, 2002

(30) Foreign Application Priority Data

Jan. 23, 2001 (JP) ..... 2001-014214

(51) Int. Cl.[7] ..... F02N 11/00; F02N 15/06
(52) U.S. Cl. ..... 74/7 R; 74/6
(58) Field of Search ..... 74/6, 7 R; 403/373

(56) References Cited

U.S. PATENT DOCUMENTS 3,955,427 A 5/1976 Squires ..... 74/6 R
4,104,926 A * 8/1978 Wilson ..... 74/6
4,184,378 A * 1/1980 Mazzorana ..... 74/7 A
4,900,945 A * 2/1990 Isozumi et al. ..... 74/7 C
5,222,401 A 6/1993 Fasola et al. ..... 74/7 A
5,353,657 A * 10/1994 Bainbridge, III ..... 74/7 A
5,878,621 A * 3/1999 Vadin-Michaud ..... 74/7 A
2001/0008092 A1 * 7/2001 Saito et al. ..... 74/6

* cited by examiner

*Primary Examiner*—David A. Bucci
*Assistant Examiner*—Bradley J. Van Pelt
(74) *Attorney, Agent, or Firm*—Oliff & Berridge, PLC

(57) ABSTRACT

A pinion gear of a starter motor is driven into engagement with a ring gear of an internal combustion engine by a driving lever having a leaf spring upon energization of an electromagnetic actuator. The leaf spring of the driving lever is coupled to a connecting member of a plunger of the electromagnetic actuator. The connecting member includes a surface engaging with an engaging portion formed at one end of the leaf spring. A center portion of the engaging surface is projected toward the leaf spring, so that the engaging portion of the leaf spring always contacts the engaging surface at the center of the engaging surface, even if the leaf spring is slantedly coupled with the connecting member.

2 Claims, 8 Drawing Sheets

FIG. 12
PRIOR ART
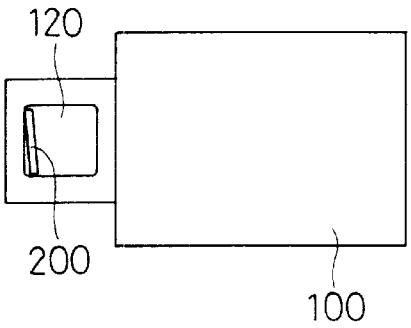
FIG. 13A
PRIOR ART
FIG. 13B
PRIOR ART
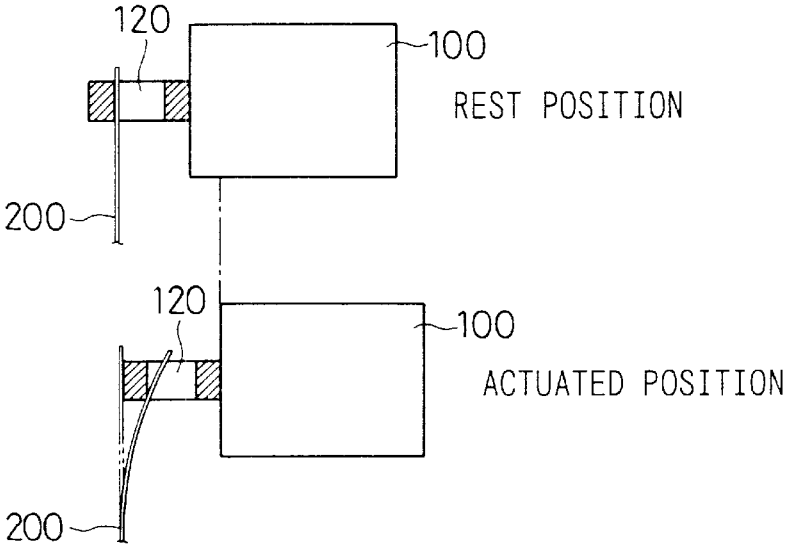

STARTER MOTOR HAVING LEAF SPRING FOR DRIVING PINION GEAR

CROSS-REFERENCE TO RELATED APPLICATION

This application is based upon and claims benefit of priority of Japanese Patent Application No. 2001-14214 filed on Jan. 23, 2001, the content of which is incorporated herein by reference.

BACKGROUND OF THE INVENTION

1. Field of the Invention

The present invention relates to a starter motor for cranking an internal combustion engine. The starter motor includes a leaf spring for driving a pinion gear to a position engaging with a ring gear of the internal combustion engine.

2. Description of Related Art

Examples of starter motors having a leaf spring for driving a pinion gear into an engaging position with a ring gear of an internal combustion engine are disclosed in JPA-5-180131 and JP-A-50-65806. As shown in FIGS. 11A and 11B, in those conventional starter motors, it is quite common to insert one end of a leaf spring 200 into a square hole 120 formed in a connecting member 110 of a plunger 100. The plunger 100 and a pinion gear of a starter motor is operably connected via the leaf spring 200. Upon actuation of an electromagnetic actuator, a pinion gear of the starter motor is driven to a position engaging with a ring gear of an engine.

Since, in the conventional starter motor, the leaf spring 200 is connected to the plunger 100 by simply inserting one end of the leaf spring 200 into the square hole 120 as shown in FIG. 11B, the leaf spring 200 may be slantedly positioned in the square hole 120 as shown in FIG. 12, if the leaf spring 200 itself is slanted or the plunger 100 takes a slanted position in the electromagnetic actuator. When the slantedly positioned leaf spring 200 is driven by the plunger 100, the driving force is concentrated to a particular portion of the leaf spring 200, thereby making a life of the leaf spring 200 shorter.

Further, as shown in FIGS. 13A and 13B, a position where the leaf spring 200 contacts the square hole 120 changes during a course of a plunger actuation. Accordingly, a lever ratio of the leaf spring 200 (which is pivotally supported on a housing) cannot be maintained constant. As a result, there is a problem that a stable resilient force of the leaf spring 200 is not obtained.

SUMMARY OF THE INVENTION

The present invention has been made in view of the above-mentioned problem, and an object of the present invention is to provide an improved structure for coupling the leaf spring to the connecting member of the plunger, and thereby to prolong the life of the leaf spring and to obtain a stable resilient force of the leaf spring.

The pinion gear of the starter motor is driven to a position where the pinion gear engages with a ring gear of an internal combustion engine by a driving lever which is driven upon energization of an electromagnetic actuator. The electromagnetic actuator includes a plunger for driving the driving lever. The plunger has a connecting member to which a leaf spring of the driving lever is coupled. The pinion gear driven into engagement with the ring gear is further pushed toward the ring gear by a resilient force of the leaf spring connected to the driving lever.

An engaging portion is formed at one end of the leaf spring, and the engaging portion is coupled to an engaging surface of a square hole formed in the connecting member. The engaging surface is projected toward the engaging portion, forming a V-shape or a sphere-shape. Because the engaging surface is projected, the engaging portion of the leaf spring always contacts the engaging surface substantially at its center even if the leaf spring is not squarely positioned in the square hole of the connecting member.

The engaging portion of the leaf spring may be made by rounding or bending one end of the leaf spring, thereby forming a portion projected toward the engaging surface. The engaging portion may be made separately from the metallic leaf spring itself, using other materials such as resin. The separately made engaging portion may be shaped in a cylinder, a ball or the like, and it is connected to one end of the leaf spring. By coupling the engaging portion having the projection and the engaging surface having the projected surface, a driving force of the plunger is stably transferred to the leaf spring.

Preferably, the height of the projection formed on the engaging surface is made larger than a radius of rounded corners of the square hole, so that the engaging portion of the leaf spring adequately contacts the engaging surface, avoiding interference with the rounded corners. Further, the engaging portion of the leaf spring can be inserted into the square hole without making a gap in its width direction, thereby restricting rotation of the plunger in an inner bore of the electromagnetic actuator.

According to the present invention, the leaf spring and the plunger is adequately coupled so that the driving force of the plunger is uniformly applied to the leaf spring, thereby prolonging the life of the leaf spring. Further, a lever ratio of the driving lever is always maintained constant.

Other objects and features of the present invention will become more readily apparent from a better understanding of the preferred embodiment described below with reference to the following drawings.

BRIEF DESCRIPTION OF THE DRAWINGS

FIG. 12 is a plan view showing a state where the leaf spring is slantedly positioned in the connecting member of the conventional starter motor; and FIGS. 13A and 13B are drawings for explaining a problem in the coupling structure of the conventional starter motor.

DETAILED DESCRIPTION OF THE PREFERRED EMBODIMENT

Figure 1A:
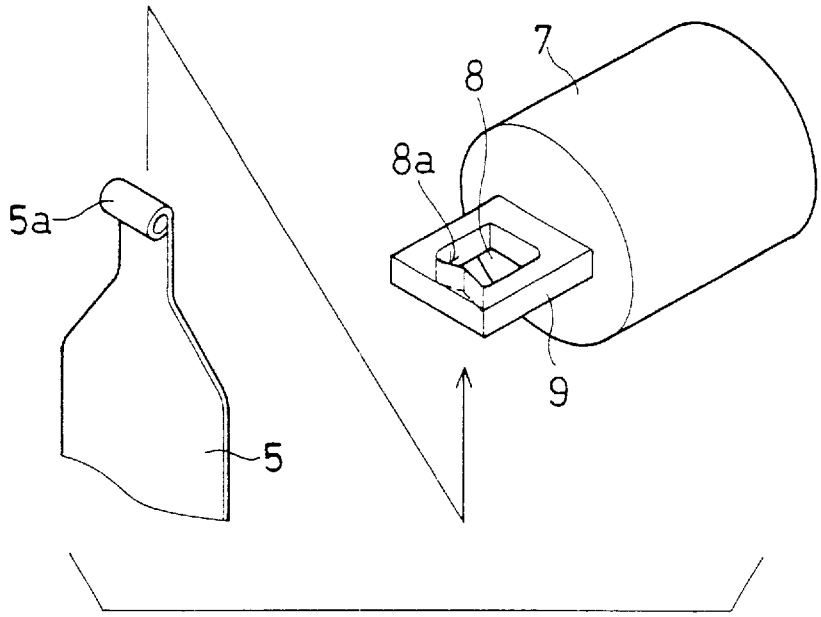
FIG. 1A is a perspective view showing a shape of a connecting member of a plunger and a shape of a engaging portion of a leaf spring, as an embodiment of the present invention.

A preferred embodiment of the present invention will be described with reference to FIGS. 1A–6. First, referring to FIG. 3, a structure of a starter motor 1 having a leaf spring 5 for driving a pinion 4 to its engaging position will be briefly described. Since this type of a starter motor is well known, details of the starter motor will not be described. An electromagnetic actuator 2 is connected to a driving shaft of the starter motor carrying a pinion 4 via a driving lever 3. The driving lever 3 is composed of a lever member 3A pivotally supported on a lever pin 6 and a metallic leaf spring 5 connected to the lever member 3A. Upon actuation of the electromagnetic actuator 2, the pinion gear 4 is driven by the driving lever 3 to a position where the pinion 4 engages with a ring gear (not shown) of an internal combustion engine. The pinion gear 4 is further pushed toward the ring gear by a resilient force of the leaf spring 5 to establish a firm engagement with the ring gear.

Figure 1B:
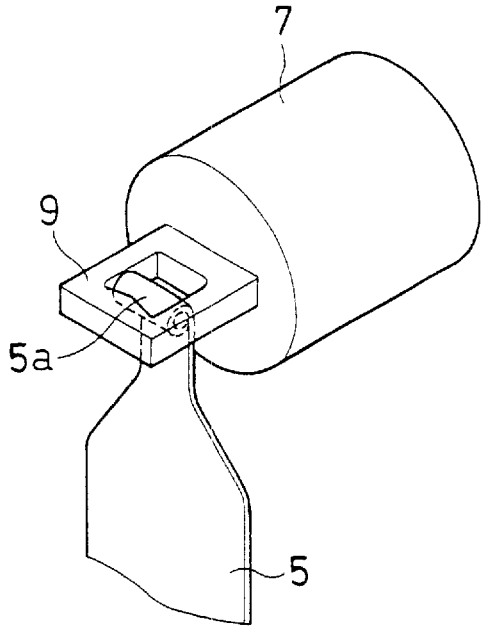
FIG. 1B is a perspective view showing a structure coupling the leaf spring to the connecting member of the plunger.

As shown in FIG. 1A, an upper end of the leaf spring 5 is rounded, forming an engaging portion 5*a* having a cylindrical or a semi-cylindrical shape. A plunger 7 of the electromagnetic actuator 2 has a connecting member 9 having a square hole 8. One surface 8*a* of the square hole 8 functions as a surface engaging with the engaging portion 5*a* of the leaf spring 5. A center of the engaging surface 8*a* is projected toward the inside of the square hole 8, forming a V-shaped projection. As shown in FIG. 1B, the upper end of the leaf spring 5 is inserted into the square hole 8, so that the engaging portion 5*a* engages with the engaging surface 8*a*.

Figure 2:
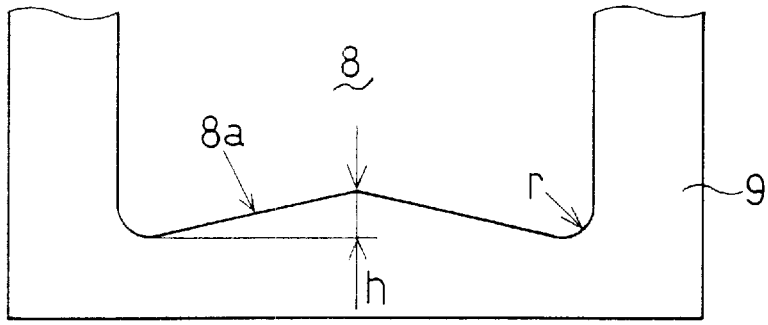
FIG. 2 is a plan view showing an engaging surface of the connecting member, in an enlarged scale.
Figure 3:
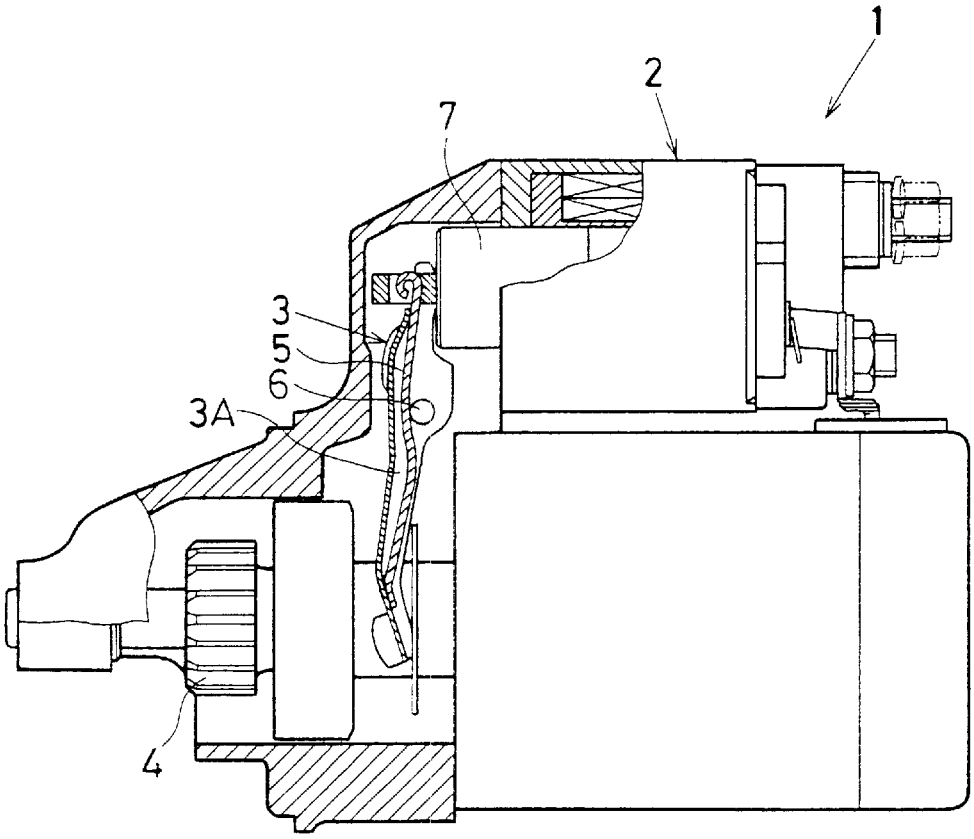
FIG. 3 is a side view, partially cross-sectioned, showing a starter motor having a leaf spring for driving a pinion gear.

Details of the engaging surface 8*a* formed in the square hole 8 are shown in FIG. 2 in an enlarged scale. The square hole 8 has corners rounded with a radius "r", and the height of the projection formed on the center of the engaging surface 8*a* is "h". The height "h" is made larger than the radius "r" (h>r).

Figure 4A:
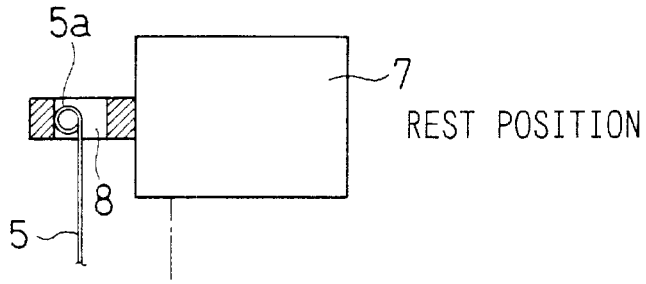
FIGS. 4A and 4B are side views, partially cross-sectioned, showing states of engagement of a leaf spring and a connecting member of a plunger, FIG. 4A showing a rest position and FIG. 4B an actuated position.
Figure 4B:
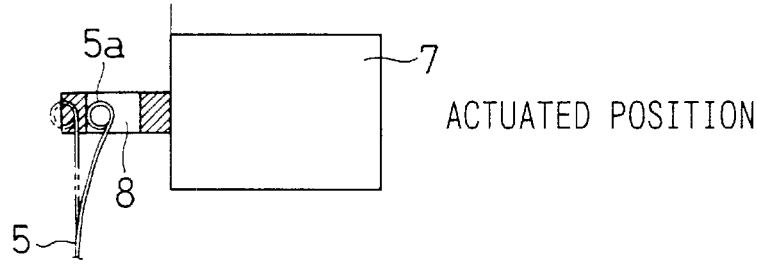

Advantages of the coupling structure according to the present invention will be explained below. FIG. 4A shows a rest position where the electromagnetic actuator 2 is not energized and the plunger 7 is extended forward. FIG. 4B shows an actuated position where the plunger 7 is pulled backward upon energization of the electromagnetic actuator 2. Even if the position of the plunger 7 moves upward or downward relative to the engaging portion 5*a*, the engaging portion 5*a* contacts the engaging surface 8*a* at its center because the engaging portion 5*a* is rounded. Further, the engaging portion 5*a* contacts the engaging surface 8*a* at its rounded center, irrespective of plunger positions, e.g., at the rest position and the actuated position of the plunger 7. This means that the lever ratio of the driving lever 3 is always kept constant, and therefore a constant resilient force of the leaf spring 5 is obtained.

Figure 5:
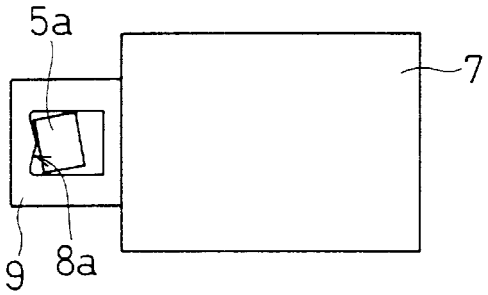
FIG. 5 is a plan view showing a state of the engagement between a leaf spring and an engaging surface having a center projection.

Since the center of engaging surface 8*a* is projected, the engaging surface 8*a* always contacts the engaging portion 5*a* at its projected center, even when the leaf spring 5 is slantedly positioned in the square hole 8 as shown in FIG. 5. Therefore, the pulling force of the plunger 7 is properly transferred to the leaf spring 5. Especially, when the rounded engaging portion 5*a* and the projected engaging surface 8*a* are used in combination as in the foregoing embodiment, the engaging surface 8*a* correctly contacts the engaging portion 5*a* at its center, even when the leaf spring 5 is positioned in the square hole 8 with a certain shift in upward-downward or rightward-leftward direction. Accordingly, the pulling force of the plunger 7 is uniformly transferred to the leaf spring 5, and thereby prolonging the life of the leaf spring 5.

Figure 6:
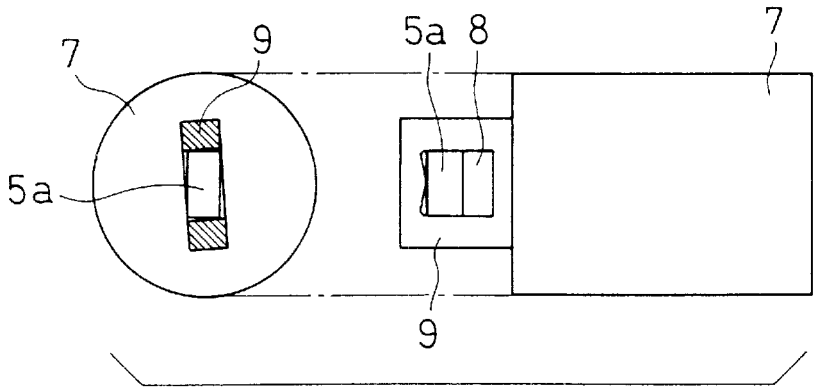
FIG. 6 shows another state of the engagement between the leaf spring and the engaging surface.

Since the projection height "h" of the engaging surface 8*a* is made larger than the corner radius "r" the engaging portion 5*a* of the leaf spring 5 correctly contacts the projected portion of the engaging surface 8*a*, avoiding contact with the corner radius. Therefore, the width of the engaging portion 5*a* can be made as wide as the width of the engaging surface 8*a*. In other words, the engaging portion 8*a* can be closely fitted in the width of the square hole 8. In this manner, as shown in FIG. 6, rotation of the plunger 7 in the inner bore of the electromagnetic actuator 2 is prevented by the engaging portion 5*a* of the leaf spring 5.

Though the driving lever 3 is composed of the lever member 3A and the leaf spring 5 in the foregoing embodiment, the driving lever 3 may be made solely by the leaf spring 5.

Figure 7A:
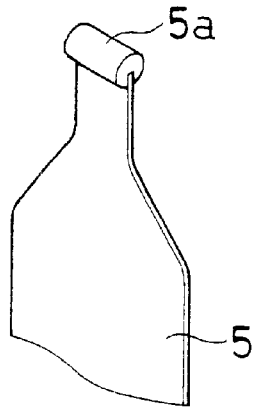
FIG. 7A is a perspective view showing a modified form of the engaging portion of the leaf spring.
Figure 7B:
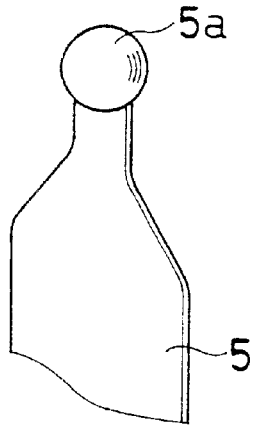
FIG. 7B is a perspective view showing another modified form of the engaging portion of the leaf spring.

The engaging portion 5*a* may be modified to forms shown in FIGS. 7A and 7B. The engaging portion 5*a* shown in FIG. 7A is made separately from the leaf spring 5 and is connected to the upper end of the leaf spring 5. The engaging portion 5*a* of this example is made in a shape of a cylindrical pillar. Because the engaging portion 5*a* is made separately from the leaf spring 5, its material can be freely selected. The engaging portion 5*a* may be made of resin, for example. As shown in FIG. 7B, the engaging portion 5*a* may be made in a shape of a ball, and the separately made ball-shaped engaging portion 5*a* is connected to the upper end of the leaf spring 5.

Figure 8:
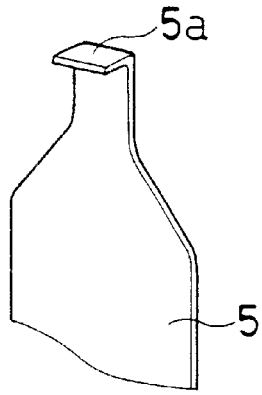
FIG. 8 is a perspective view showing yet another modified form of the engaging portion of the leaf spring.

Further, the engaging portion 5*a* may be modified in a form shown in FIG. 8. In this example, the upper end of the leaf spring 5 is bent in an L-shape. The L-shaped engaging portion 5*a* correctly contacts the engaging surface 8*a*, and the pulling force of the plunger 7 is adequately transferred to the leaf spring 5.

Figure 9A:
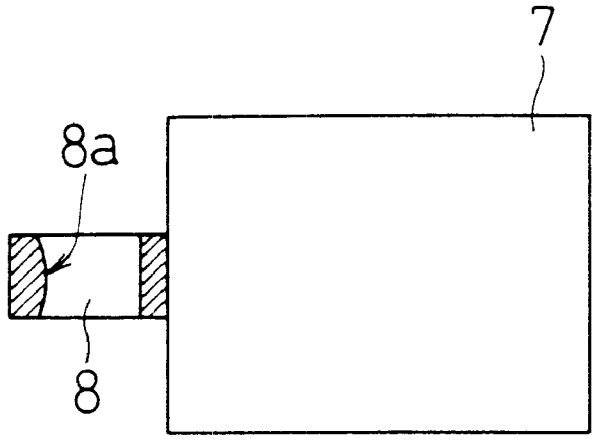
FIG. 9A is a side view, partially cross-sectioned, showing a modified form of the engaging surface of the connecting member.
Figure 9B:
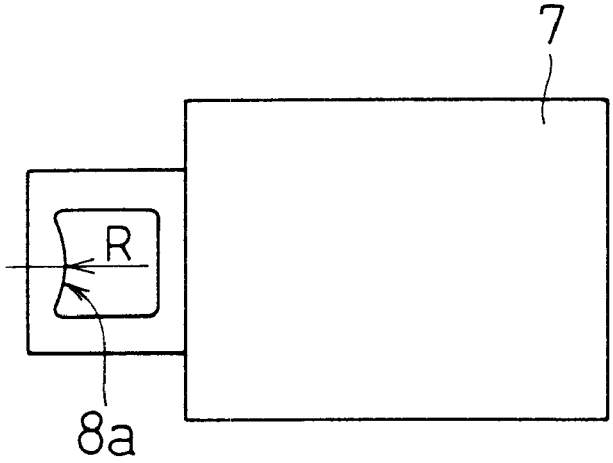
FIG. 9B is a plan view showing the modified form of the engaging surface shown in FIG. 9A.

The engaging surface 8*a* may be modified to a form shown in FIGS. 9A and 9B (FIG. 9A shows a cross-sectional view, and FIG. 9B shows a plan view of the engaging surface 8*a*). In this example, the engaging surface 8*a* is made in a shape of a sphere having a radius R. Since the center portion of the engaging surface 8*a* is projected in this example, too, the pulling force of the plunger 7 is transferred from the center of the engaging surface 8*a* to the leaf spring 5. Therefore, the same advantages as those of the foregoing embodiment can be obtained.

Figure 10A:
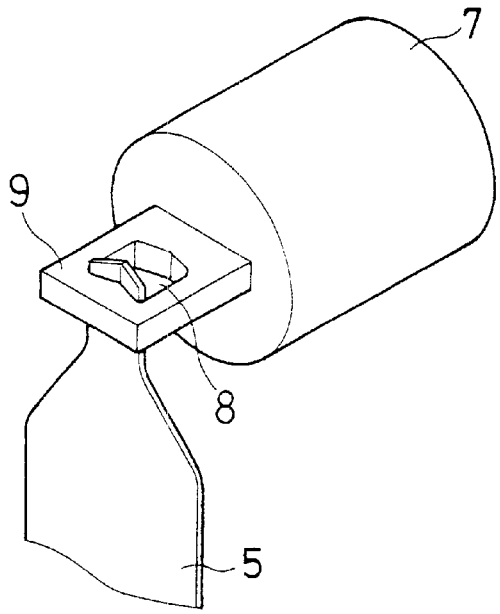
FIGS. 10A and 10B are perspective views showing a modified form of the engaging structure.
Figure 10B:
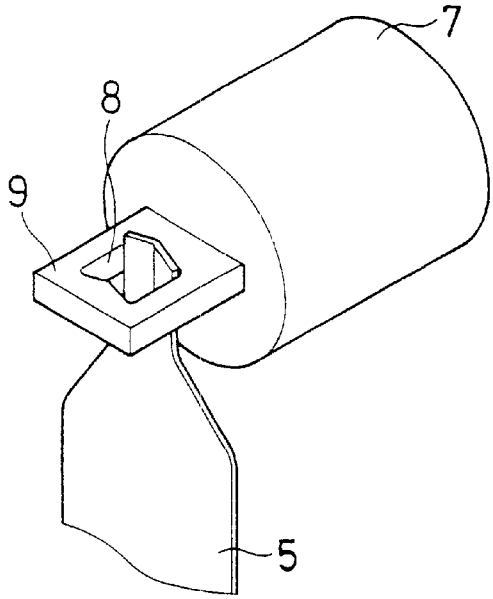
Figure 11A:
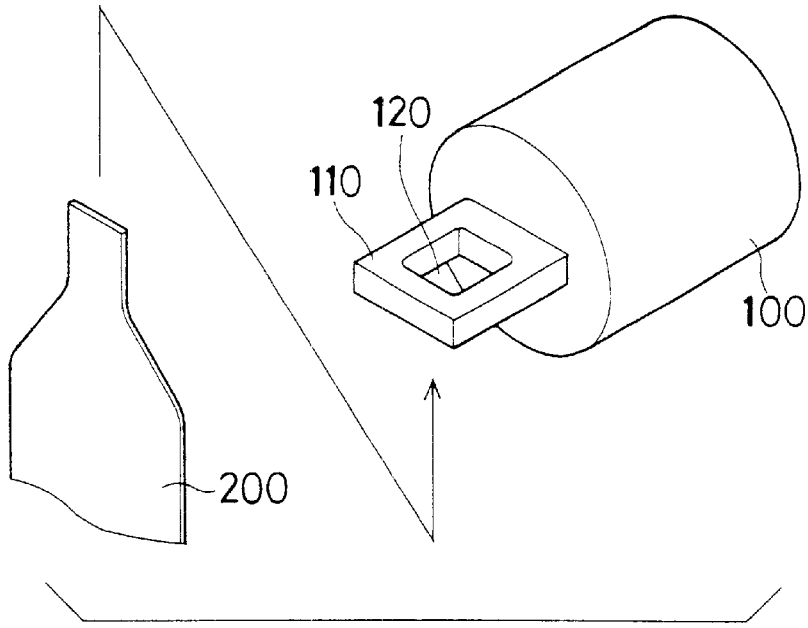
FIG. 11A PRIOR ART
FIG. 11A is a perspective view showing a connecting member of a plunger and a leaf spring to be coupled to the connecting member in a conventional starter motor.
Figure 11B:
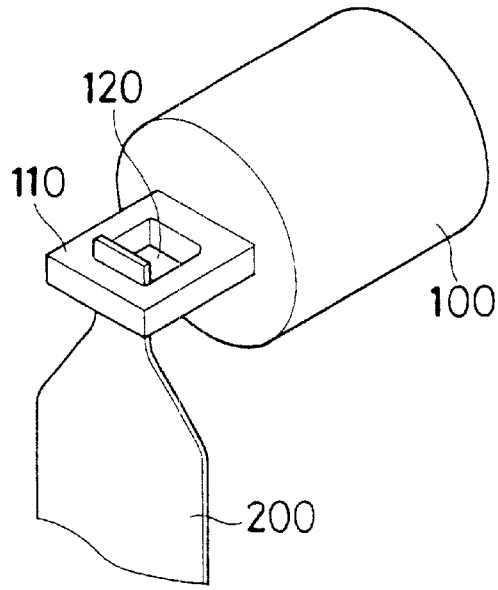
FIG. 11B PRIOR ART
FIG. 11B is a perspective view showing a structure coupling the leaf spring to the connecting member in the conventional starter motor.

The structure for coupling the leaf spring 5 to the square hole 8 may be made in a form shown in FIGS. 10A and 10B.

FIG. 10A shows the actuated position, and FIG. 10B shows the rest position. In this example, a front surface (an engaging surface) of the square hole 8 is projected to form a V-shape, while a rear surface is depressed to form an inverse-V-shape. The upper end of the leaf spring 5 is also V-shaped to fit with the V-shaped front surface and the inverse-V-shaped rear surface. As shown in FIG. 10A, the upper end of the leaf spring 5 fits with the front surface of the square hole 8 when the plunger 7 is actuated (the actuated position). As shown in FIG. 10B, the upper end of the leaf spring 5 fits with the rear surface when the plunger takes the rest position upon de-energization of the electromagnetic actuator 2. Since the leaf spring 5 fits with the front surface of the square hole at the actuated position and with the rear surface at the rest position, the leaf spring positions are always corrected by both surfaces of the square hole 8 even if the leaf spring 5 is not squarely positioned in the square hole 8. Therefore, the pulling force of the plunger 7 is uniformly applied to the leaf spring 5, and the leaf spring 5 can be used for a long time without fail. In addition, rotation of the plunger 7 is restricted by the leaf spring 5 closely fitted in the square hole 8.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A starter motor, comprising:

an electromagnetic actuator having a plunger to which a connecting member is connected;

a driving lever having a leaf spring coupled to the connecting member, the driving lever being adapted to drive a pinion gear of the starter motor to a position where the pinion gear engages with a ring gear of an internal combustion engine upon energization of the electromagnetic actuator, wherein the connecting member includes a surface engaging with an engaging portion formed at one end of the leaf spring, and a center portion of the engaging surface is projected toward the engaging portion of the leaf spring, the engaging surface is formed in a square hole formed in the connecting member, the square hole having round corners, and the engaging surface is projected in an amount larger than a radius of the round corners of the square hole.

2. A starter motor, comprising:

an electromagnetic actuator having a plunger to which a connecting member is connected;

a driving lever having a leaf spring coupled to the connecting member, the driving lever being adapted to drive a pinion gear of the starter motor to a position where the pinion gear engages with a ring gear of an internal combustion engine upon energization of the electromagnetic actuator, wherein the connecting member includes a surface engaging with an engaging portion formed at one end of the leaf spring, and a center portion of the engaging surface is projected toward the engaging portion of the leaf spring, and the engaging surface is projected to form a V-shape.

* * * * *